US010085901B1

(12) United States Patent
Steinbock et al.

(10) Patent No.: US 10,085,901 B1
(45) Date of Patent: Oct. 2, 2018

(54) LIGHTWEIGHT INTEGRATED FIELD TRANSPORT SYSTEM

(71) Applicant: Matbock, LLC, Virginia Beach, VA (US)

(72) Inventors: Zachary L. Steinbock, Virginia Beach, VA (US); Sean M. Matson, Virginia Beach, VA (US)

(73) Assignee: Matbock, LLC, Virginia Beach, VA (US)

( * ) Notice: Subject to any disclaimer, the term of this patent is extended or adjusted under 35 U.S.C. 154(b) by 0 days.

(21) Appl. No.: 15/479,229

(22) Filed: Apr. 4, 2017

Related U.S. Application Data

(63) Continuation of application No. 13/439,042, filed on Apr. 4, 2012, now Pat. No. 9,610,204.

(51) Int. Cl.

| | |
|---|---|
| ***A61G 1/00*** | (2006.01) |
| ***A61G 1/01*** | (2006.01) |
| ***A61G 1/013*** | (2006.01) |
| ***B65D 33/25*** | (2006.01) |
| ***B65D 33/28*** | (2006.01) |
| ***B65D 33/06*** | (2006.01) |

(52) U.S. Cl.
CPC ..... *A61G 1/01* (2013.01); *A61G 1/013* (2013.01); *B65D 33/06* (2013.01); *B65D 33/25* (2013.01); *B65D 33/28* (2013.01)

(58) Field of Classification Search
CPC ..... A61G 1/01; A61G 1/013; B65D 33/06; B65D 33/25; B65D 33/28
USPC ..... 383/4, 6; 5/625–627
See application file for complete search history.

(56) References Cited

U.S. PATENT DOCUMENTS

| | | | |
|---|---|---|---|
| 3,671,983 | A | 6/1972 | Bertolet |
| 3,797,043 | A | 3/1974 | Brument |
| 4,296,788 | A | 10/1981 | Slater |
| 4,301,920 | A | 11/1981 | Boggs |
| 4,442,557 | A | 4/1984 | Clemens |
| 4,484,362 | A | 11/1984 | Asher |
| 4,519,183 | A | 5/1985 | Parody |
| 4,621,382 | A | 11/1986 | Burriss et al. |
| 4,723,300 | A | 2/1988 | Aranow |
| 4,723,327 | A | 2/1988 | Smith |
| 5,092,681 | A | 3/1992 | Ashley, III |
| 5,386,604 | A | 2/1995 | Ricketts |
| 5,442,821 | A | 8/1995 | Weeks |
| 5,588,749 | A | 12/1996 | Ishikawa |
| 5,720,303 | A | 2/1998 | Richardson |
| 5,978,989 | A | 11/1999 | Chavez |
| 6,477,728 | B1 | 11/2002 | Faz |
| 6,634,044 | B1 | 10/2003 | Wright |
| 6,874,176 | B2 | 4/2005 | Berge |
| 6,948,203 | B2 | 11/2005 | Tsai |

(Continued)

OTHER PUBLICATIONS

TAC MED Solutions Store; Phantom Lifter; pp. 1-2; https://www.tacmedsolutions.com/store/products.

*Primary Examiner* — Peter Helvey
(74) *Attorney, Agent, or Firm* — Middleton Reutlinger; Alexander P. Brackett

(57) ABSTRACT

The present invention comprises a field transport system that converts readily from a litter or stretcher to a gear bag for carrying loose items. The invention includes a base layer strengthened and supported by a frame that permits the use of litter poles. The invention also includes a novel zipper arrangement whereby the litter can be quickly folded and zipped into a bag having a drawstring closure at a top end thereof.

7 Claims, 12 Drawing Sheets

(56) References Cited

U.S. PATENT DOCUMENTS

| | | | |
|---|---|---|---|
| 7,168,110 | B2 | 1/2007 | Girard et al. |
| 7,707,666 | B2 | 5/2010 | Calkin et al. |
| 7,785,008 | B2 | 8/2010 | Schoenig et al. |
| 7,832,743 | B2 | 11/2010 | Small |
| 7,865,986 | B2 | 1/2011 | Smart |
| 8,065,765 | B2 | 11/2011 | Rincon |
| 8,336,141 | B2 | 12/2012 | Wong |
| 9,610,204 | B1 | 4/2017 | Steinbock et al. |
| 2002/0162171 | A1 | 11/2002 | Faz |
| 2003/0070234 | A1 | 4/2003 | Smith et al. |
| 2004/0010852 | A1 | 1/2004 | Elroy |
| 2004/0088794 | A1 | 5/2004 | Calkin |
| 2004/0226095 | A1 | 11/2004 | Lohse et al. |
| 2007/0025646 | A1 | 2/2007 | Schoenig et al. |
| 2007/0136950 | A1 | 6/2007 | Zuercher |
| 2009/0038076 | A1 | 2/2009 | Giduck |
| 2009/0288255 | A1 | 11/2009 | Sakurai et al. |
| 2010/0008601 | A1 | 1/2010 | Prudencio |
| 2011/0119831 | A1 | 5/2011 | Rincon |
| 2011/0265263 | A1 | 11/2011 | Bartholomew |
| 2011/0271450 | A1 | 11/2011 | Johnson et al. |
| 2012/0284923 | A1 | 11/2012 | Jensen et al. |

LIGHTWEIGHT INTEGRATED FIELD TRANSPORT SYSTEM

FIELD OF THE INVENTION

The present invention relates generally to a gear bag and more particularly to a convertible bag that is quickly adapted from its use for carrying gear or other loose items to a litter for carrying injured personnel or other bulky loads.

BACKGROUND OF THE INVENTION

A variety of bags and packs of varying shapes and sizes are presently available for carrying loads required in the field. In military applications alone, a dizzying array of duffels, backpacks, belt pouches and the like are available for any and every application. Furthermore, some portion of these bags are required to be able to carry gear as well as convert to other uses, such as stretchers or litters for carrying injured personnel or bulky or heavy loads that require more than one person to transport.

However, many of these existing convertible gear bags are typically complex in their construction, costly to produce, and require many steps to "convert" the bag from one purpose to another. For military applications it is critical that a convertible gear bag take very little time to convert to a litter, and further that it is readily reassembled into a gear bag with minimum effort. Accordingly, there is a need in the art for a collection and carry bag that is readily convertible between a gear bag and a litter that is simple, easy to operate, and economical to produce, thereby overcoming the inherent deficiencies in the prior art.

SUMMARY OF THE INVENTION

The present invention overcomes the disadvantages of the prior art by providing a lightweight integrated field transport system that is constructed of a lightweight, strong base material such as rip-stop nylon reinforced with a frame that is secured around the perimeter of the base layer for reinforcing the edges thereof. The frame also includes a plurality of flexible material ribs secured to the base material to provide strength and to provide a "stop" in the event that a tear forms in some portion of the base material. The frame may be constructed of any strong material that is readily folded, for example flashspun high density polyethylene or nylon.

The invention further includes a plurality of handles secured to the frame at the corners thereof and proximate the terminal ends of the frame ribs. The corner handles are provided with a pole pocket that captures the end of a suitable pole for assisting in carrying bag when it is unfolded in a litter configuration. Combat carbon poles may then be inserted through the rib handles whereby the ends are secured in the pole pockets to create a field expedient stiff medical litter to aid in transporting injured personnel.

Additionally, a novel zipper arrangement is provided that permits the litter to be quickly folded into a generally rectangular shape, and then zipped into a bag with a drawstring or equivalent closure along a top edge thereof. Hook and loop fasteners provided around portions of the frame enable the partially folded bag to be quickly arranged for zipping.

Other objects, features and advantages of the present invention will be readily apparent from the detailed description of the preferred embodiments included herein below in conjunction with the drawing Figures.

BRIEF DESCRIPTION OF THE DRAWING FIGURES

DETAILED DESCRIPTION OF THE PREFERRED EMBODIMENT(S)

Figure 1:
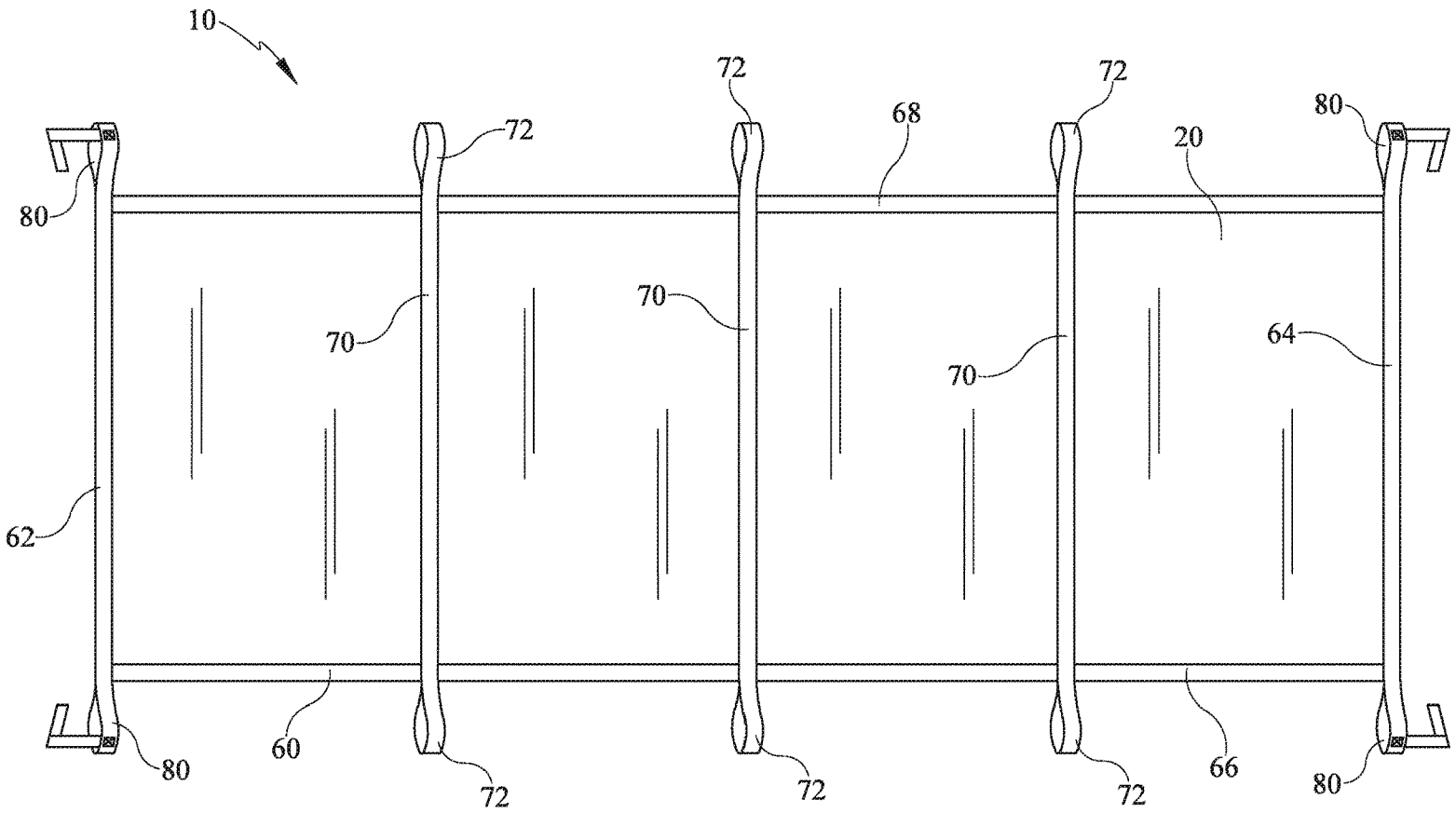
FIG. 1 is a schematic diagram of an unfolded lightweight integrated field transport system in accordance with one embodiment of the present invention.
Figure 2:
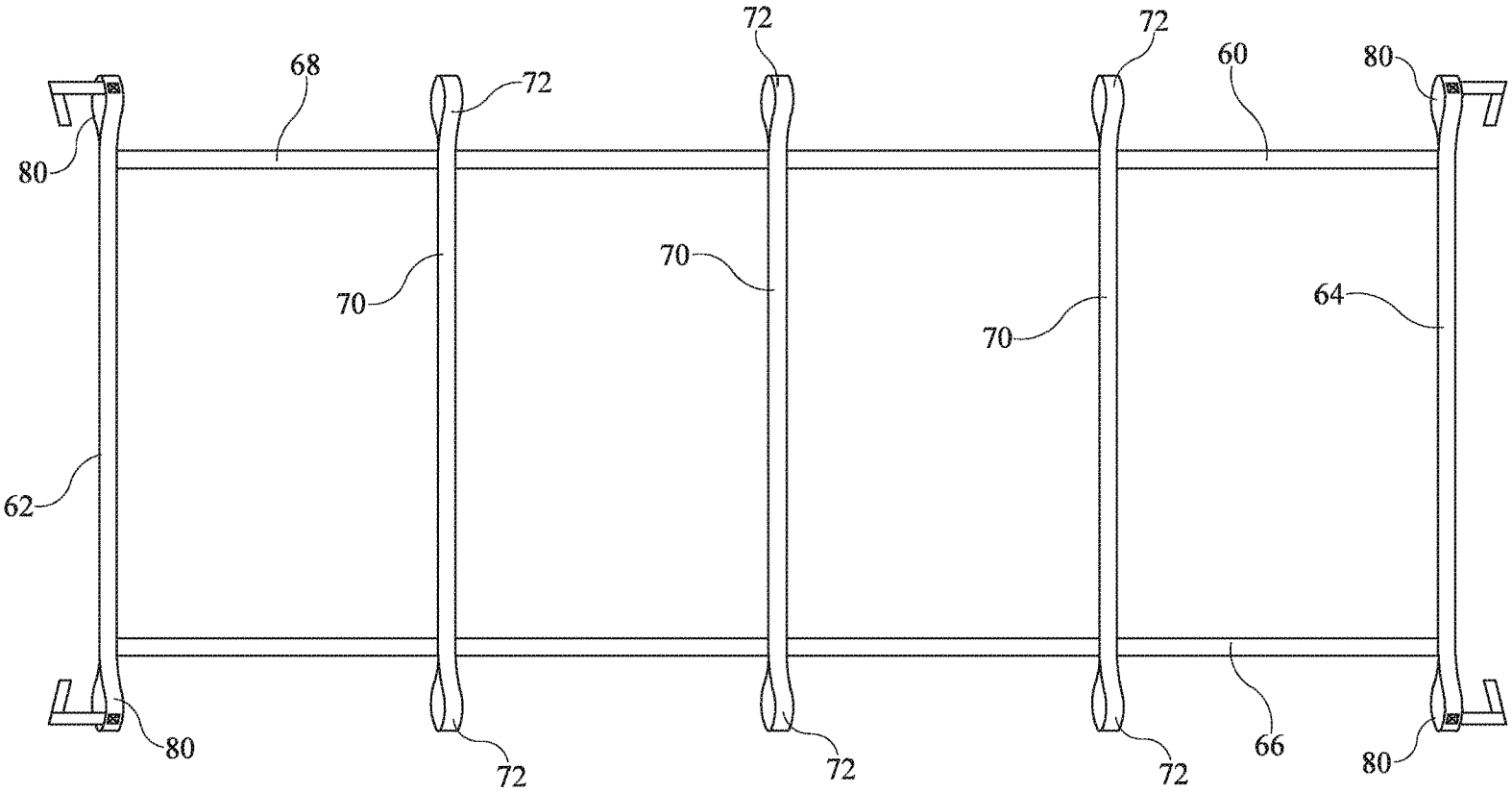
FIG. 2 is a schematic diagram of an unfolded frame of a field transport system in accordance with one embodiment of the present invention.

Referring now to drawing FIGS. 1 and 2, and in accordance with a preferred constructed embodiment of the present invention, a lightweight integrated field transport system 10 for both stowing gear and use as a litter or stretcher comprises base layer 20 and a frame 60 secured thereto to produce an unfolded bag 10. Base layer 20 may be constructed of any strong flexible and foldable material, although in one embodiment of the invention base layer 20 comprises a layer of rip-stop nylon capable of repelling moisture and having sufficient strength to act as a litter or stretcher for a wounded patient. However, base layer 20 may comprise any other material suitable for use as a litter and sufficiently flexible to be folded into a bag configuration, as will be discussed in detail below. Base layer may be any suitable size, or shape for that matter. In one exemplary embodiment of the present invention base layer 20 (unfolded) is generally rectangular in shape, having a width of 29" and a length of 78".

As best seen in FIG. 2, frame 60 includes first and second opposed short sides 62, 64 respectively, and first and second opposed long sides 66, 68 respectively that together define a perimeter of base layer 20. Frame 60 short and long sides 62, 64, 66 and 68 may be sewn, bonded or otherwise secured to base layer 20 and may comprise, for example, a 4" wide flash spun high density polyethylene material such as Tyvek® or the equivalent. In this embodiment of the invention, the 4" wide material sides 62, 64, 66 and 68 may be folded in half around the perimeter of base layer 20, to provide a 2" wide perimeter for the entire base layer 20. It should be noted that the dimensions and materials discussed herein for the various components of the present invention are exemplary only and are intended for illustrative purposes. These dimensions and materials should not be viewed in any way as limiting the scope of the present invention.

Frame 60 further comprises a plurality of ribs 70 secured across base layer 20 from first long side 66 to second long side 68 to provide additional strength and support to base layer 20 along its length. Ribs 70 also function to inhibit or stop any tear or hole that may form in base layer 20 from expanding and thus rendering the litter unusable. Ribs 70 may also be formed of flash spun high density polyethylene material to provide strength and stability to base layer 20 along the length thereof. In one embodiment of the invention, ribs 70 comprise a 2" strip of ripstop nylon, Tyvek®, or equivalent material is secured to both sides of base layer 20 such that ribs 70 are present on both the top and bottom of base layer 20.

Each rib 70 includes a pair of handles 72 at each end thereof to facilitate carrying bag 10 when unfolded and in use as a litter. Handles 72 may be formed as a continuous piece of material with ribs 70. In one example, handles 72 form a 5" loop at either end of ribs 70 to provide easy access for a hand to grasp. While in one exemplary embodiment of the present invention ribs 70 and handles 72 are constructed of flash spun high density polypropylene, one of ordinary skill in the art will understand that ribs 70 and handles 72 may be constructed by a wide variety of durable, flexible materials without departing from the scope of the present invention.

Also shown in FIGS. 1 and 2, frame 60 further includes four corner handles 80 provided at the intersections of short sides 62, 64 and long sides 66, 68 of frame 60 for grasping the corners of unfolded bag 10. Corner handles 80, in one exemplary embodiment of the invention, may be constructed of 1" nylon webbing or any equivalent material. As best seen in drawing FIGS. 9-11, handles 80 may further include a litter pole pocket 82 that accepts an end of a litter pole 90 for supporting unfolded bag 10 when it is being used as a litter. Pole pocket 82 may positioned away from handle 80 by extension 84 that is secured to handle 80. Poles 90 may then be positioned through handles 72 and 80 such that the ends thereof are secured in pole pocket 82. This feature of the present invention permits the bag/litter 10 to be readily transported without concern of poles 90 sliding away from handles 80 by simply grasping poles 90 and lifting.

Figure 11:
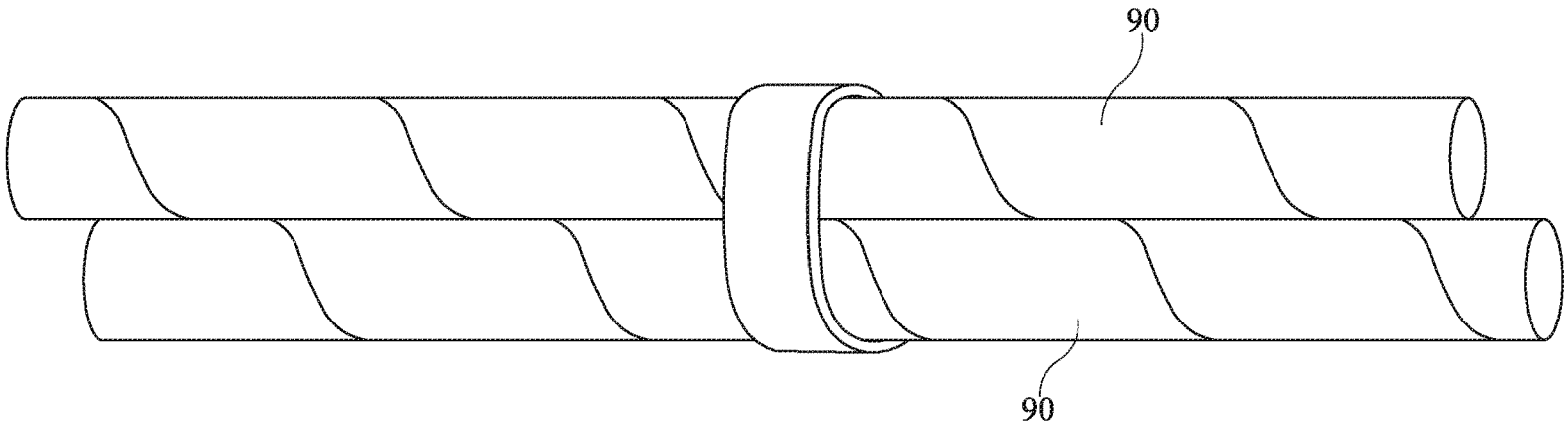
FIG. 11 is a perspective view of a stowed pole assembly in accordance with one embodiment of the present invention.

Furthermore, and as best seen in FIG. 11 poles 90 may comprise carbon fiber poles, such as those utilized in military applications for their strength, durability and light weight. However, a wide variety of poles may be utilized with the present invention without departing from the scope thereof.

Figure 3:
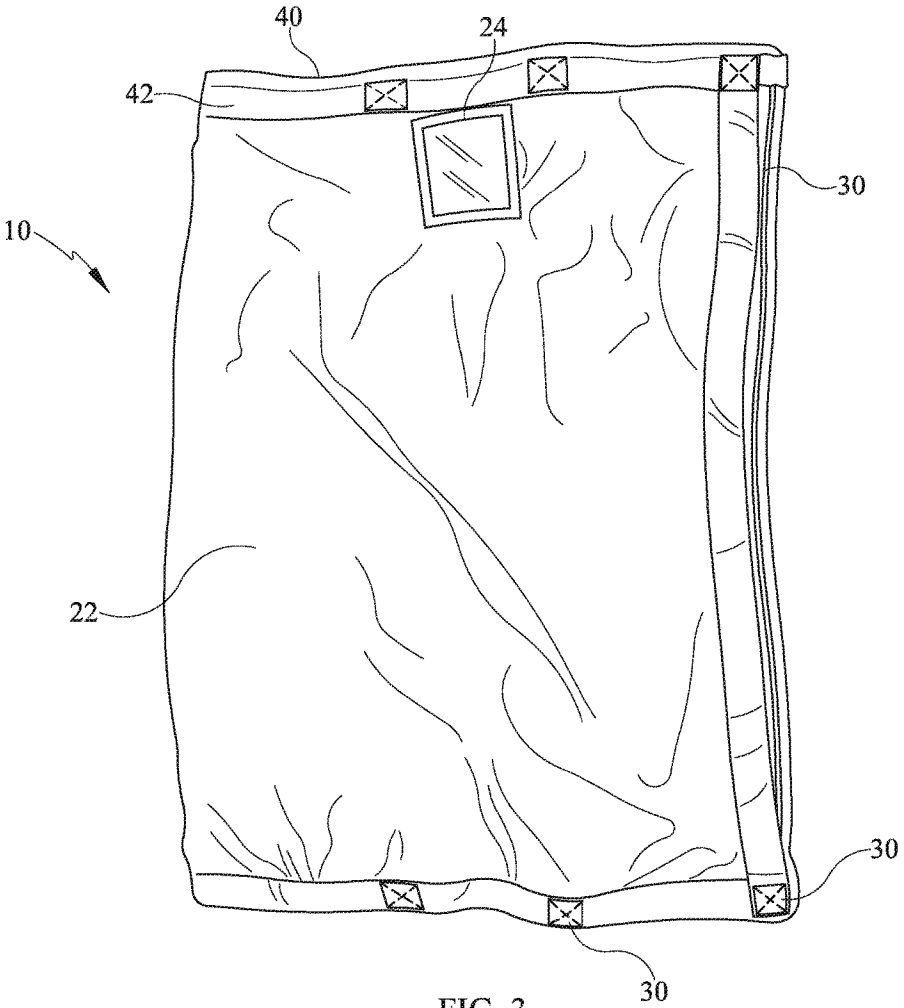
FIG. 3 is a front view of a field transport system in accordance with one embodiment of the present invention.

Referring now to FIGS. 3-7 bag 10 is depicted as fully assembled (that is, folded and zipped). FIG. 3 depicts a front 22 of bag 10 wherein an identification pocket 24 is secured to front 22 of bag 10 for accepting an identification card or description of contents or the like. FIG. 3 further depicts a zipper 30 extending down one side of bag 10 and across the bottom thereof. The arrangement of zipper 30 along short side 62 and first long side 66 of bag 10 when bag 10 is properly folded permits bag 10 to be completely opened and folded flat, thereby permitting quick access to all contents as well as providing rapid conversion to a litter. The exact location of zipper 30 is described further herein below.

Figure 4:
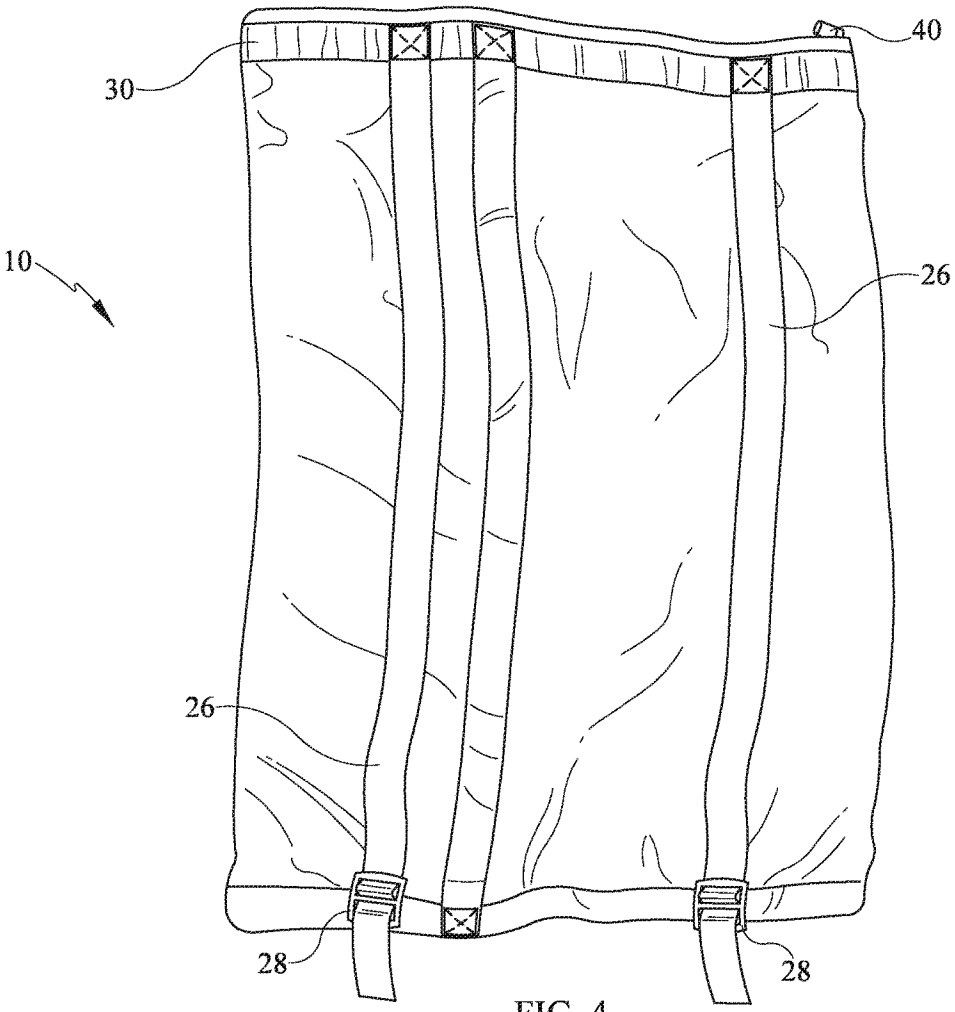
FIG. 4 is a rear view of a field transport system in accordance with one embodiment of the present invention.
Figure 5:
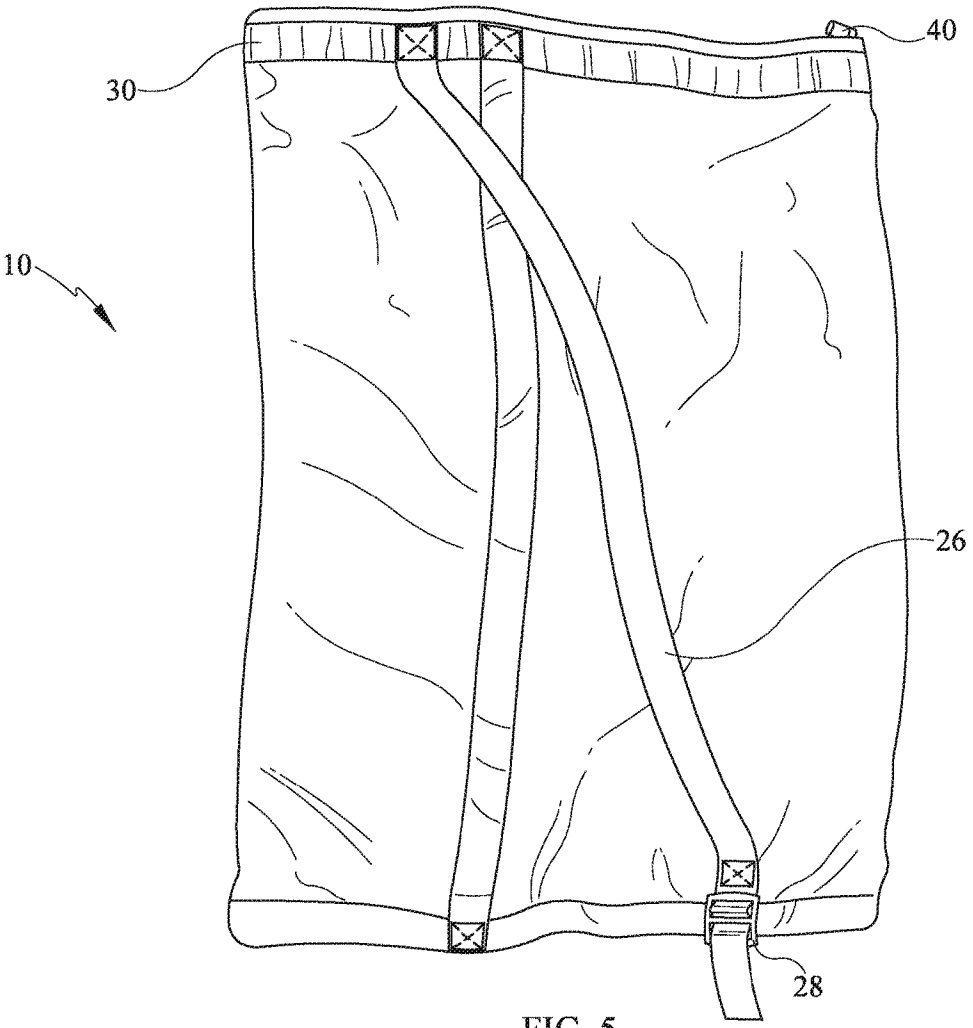
FIG. 5 is a rear view of a field transport system in accordance with one embodiment of the present invention.

FIGS. 4 and 5 depict the back of bag 10, wherein there are secured a plurality of shoulder straps 26 secured to bag 10 and equipped with a conventional strap adjusters 28. Straps 26 may be constructed of a simple nylon webbing strap, for example, or any other strap suitable to support the weight of bag 10 and its contents. FIG. 5 depicts an alternative embodiment of the present invention wherein a single strap 26 is secured diagonally across the back of bag 10 for ease of carrying. Straps 26 may be secured to bag 10 by sewing or bonding as required. Furthermore, in each instance in the invention wherein a strap 26 or handle 72, 80 is secured to bag 10, it should be noted that gussets or equivalent reinforcements may be used at the attachment points without departing from the scope of the invention. Additionally, a drawstring 40 is secured in a top seam 42 along the top of bag 10 for quickly closing and securing the top thereof.

Figure 6:
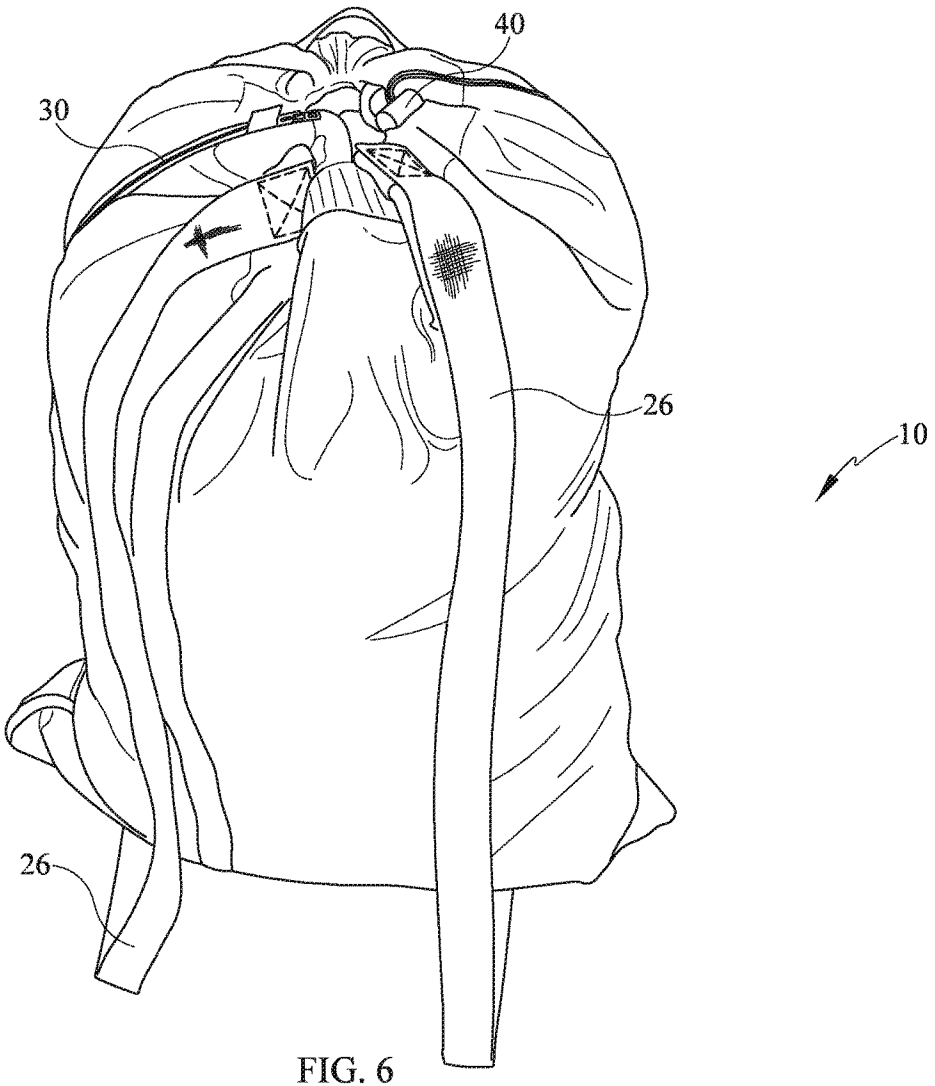
FIG. 6 is a perspective view of an assembled and packed field transport system in accordance with one embodiment of the present invention.
Figure 7:
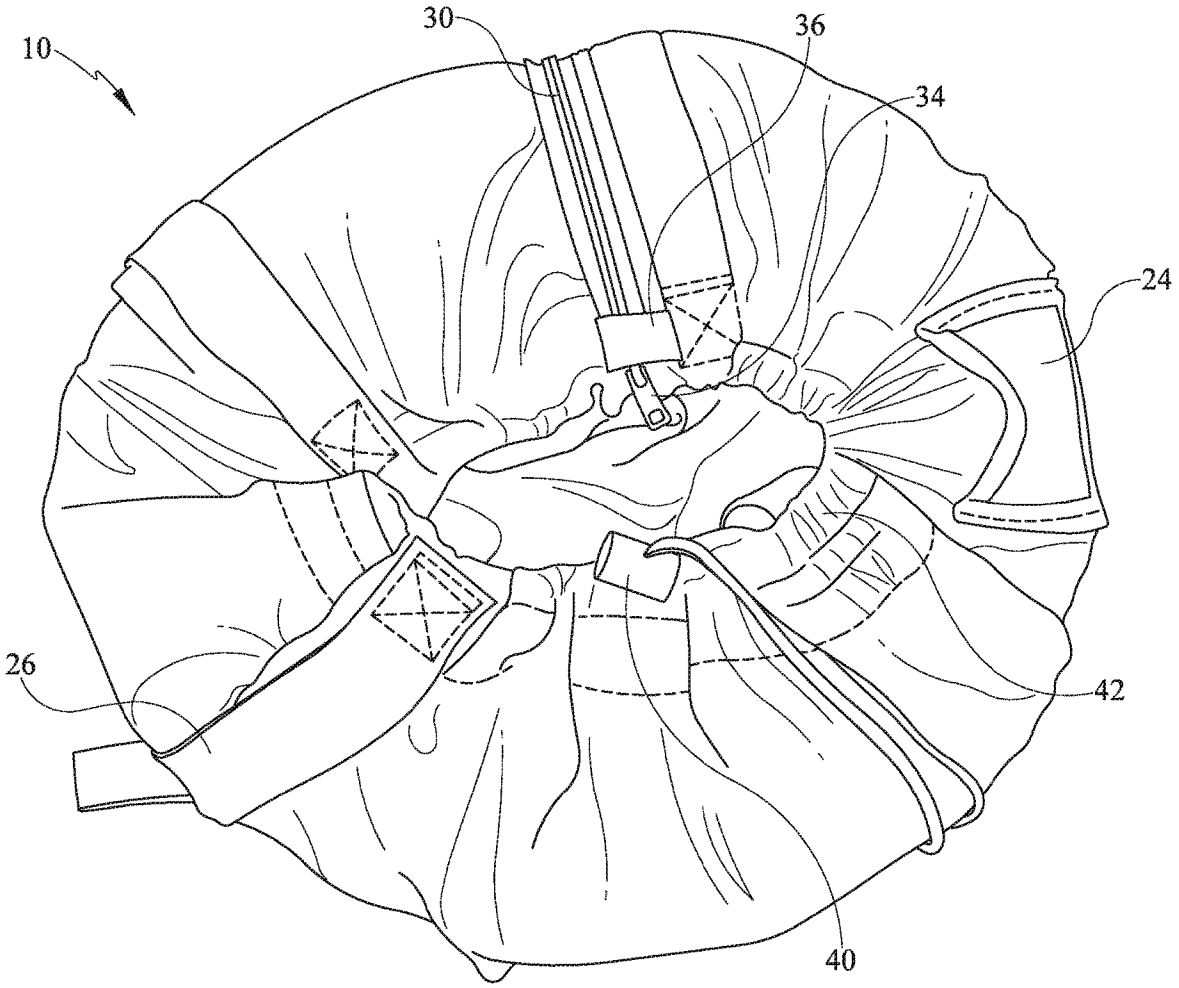
FIG. 7 is a top view of an assembled and packed field transport system in accordance with one embodiment of the present invention.

FIGS. 6 and 7 depict bag 10 fully assembled wherein zipper 30 is zipped along one side and bottom of bag 10. Drawstring 40 is then used to cinch the top of bag 10 shut to protect its contents.

Figure 8:
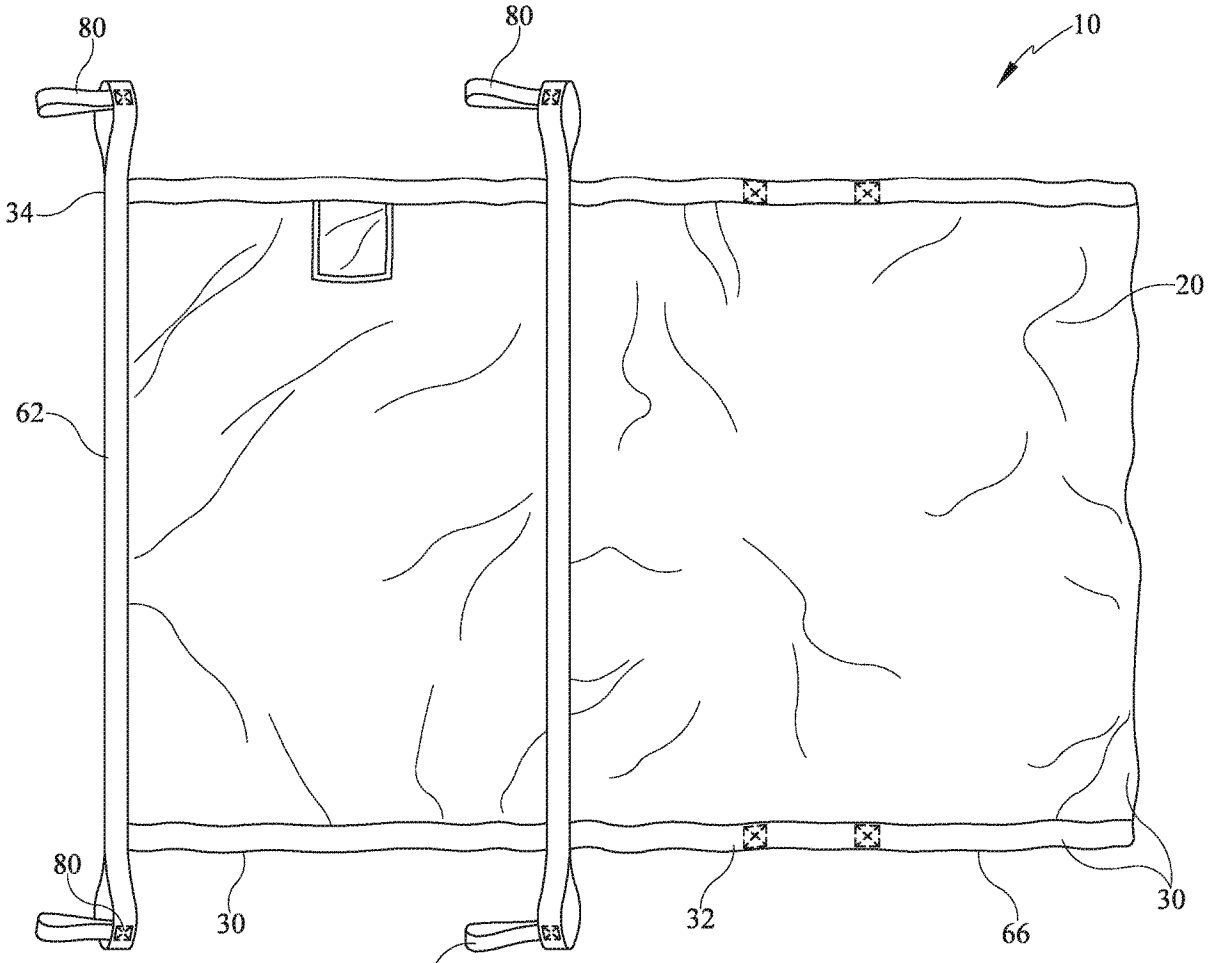
FIG. 8 is a perspective view of a partially unfolded field transport system in accordance with one embodiment of the present invention.
Figure 9:
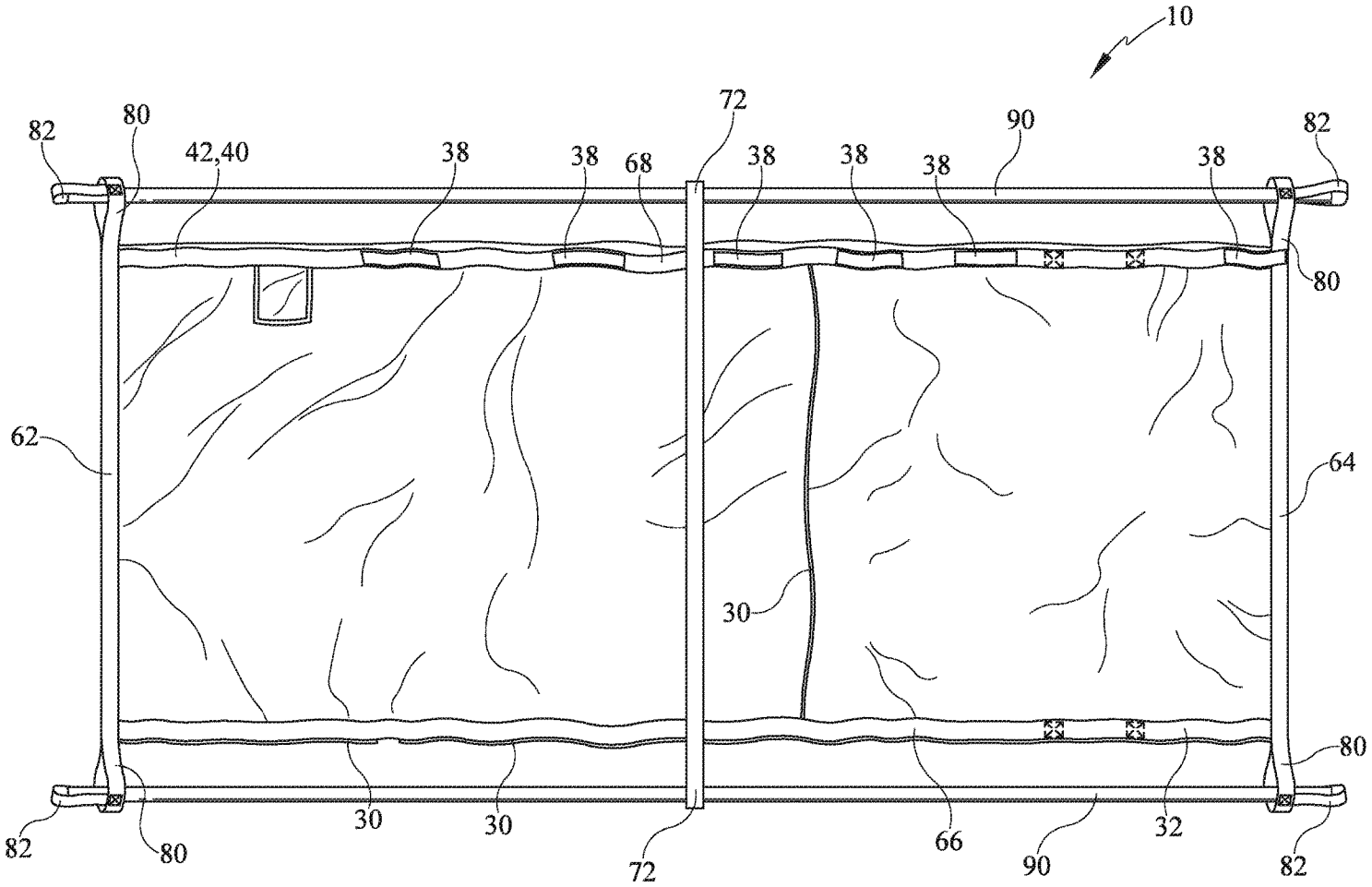
FIG. 9 is a perspective view of an unfolded field transport system in accordance with one embodiment of the present invention.
Figure 10:
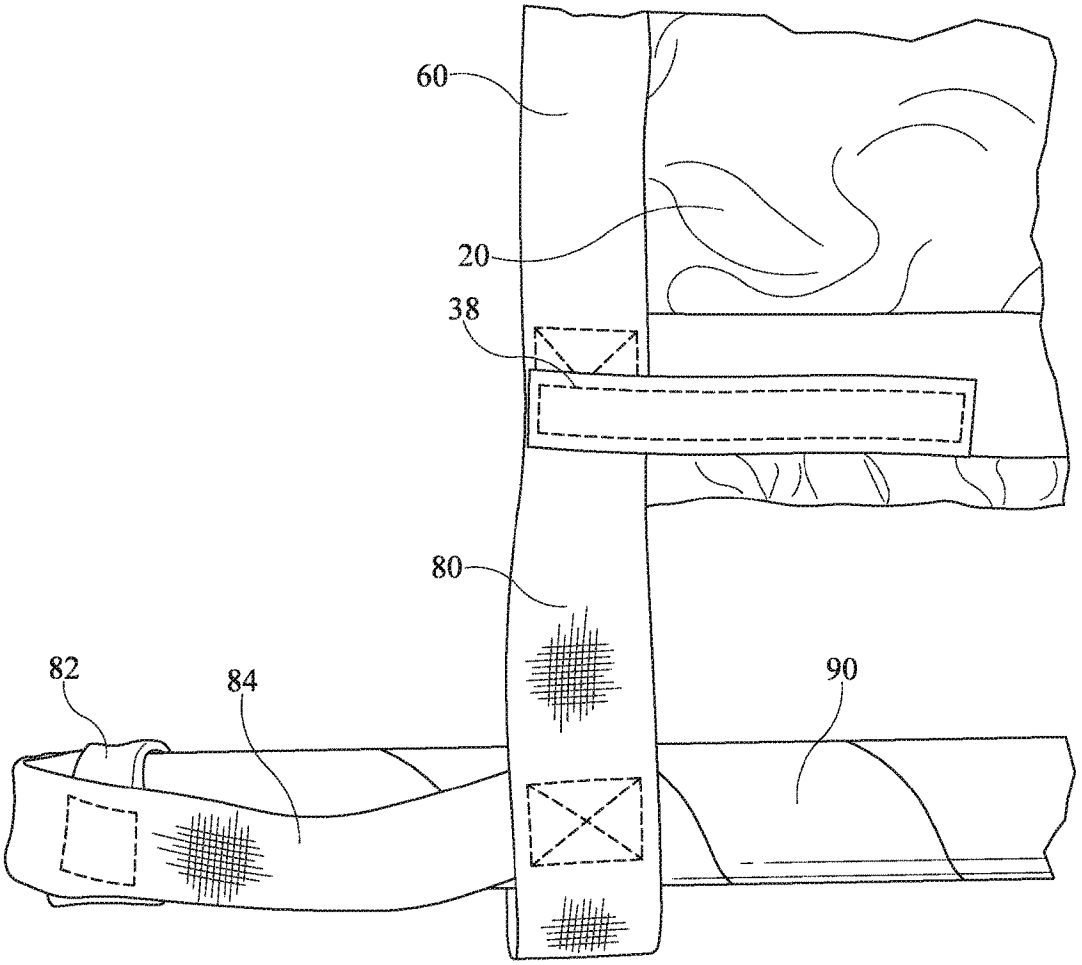
FIG. 10 is a detailed view of a corner handle and pole assembly in accordance with one embodiment of the present invention.

Referring now to FIG. 8 there is depicted bag 10 in a partially unfolded position while FIG. 9 depicts bag 10 completely unfolded and deployed as a litter. In one exemplary embodiment of the invention, zipper 30 is secured along the perimeter of bag 10 along first short side 62, along a portion of first long side 66, and then across base layer 20 from first long side 66 to second long side 68. The routing of zipper 30 across base layer 20 from first long side 66 to second long side 68 is best seen in FIG. 9. The precise length of zipper 30 and its' positioning along the perimeter of bag 10 and across base layer 20 depends upon the size of the finished bag 10 that is desired. By moving that portion of zipper 30 that crosses base layer 20 further towards second short side 64, the size of bag 10 is increased.

Figure 12:
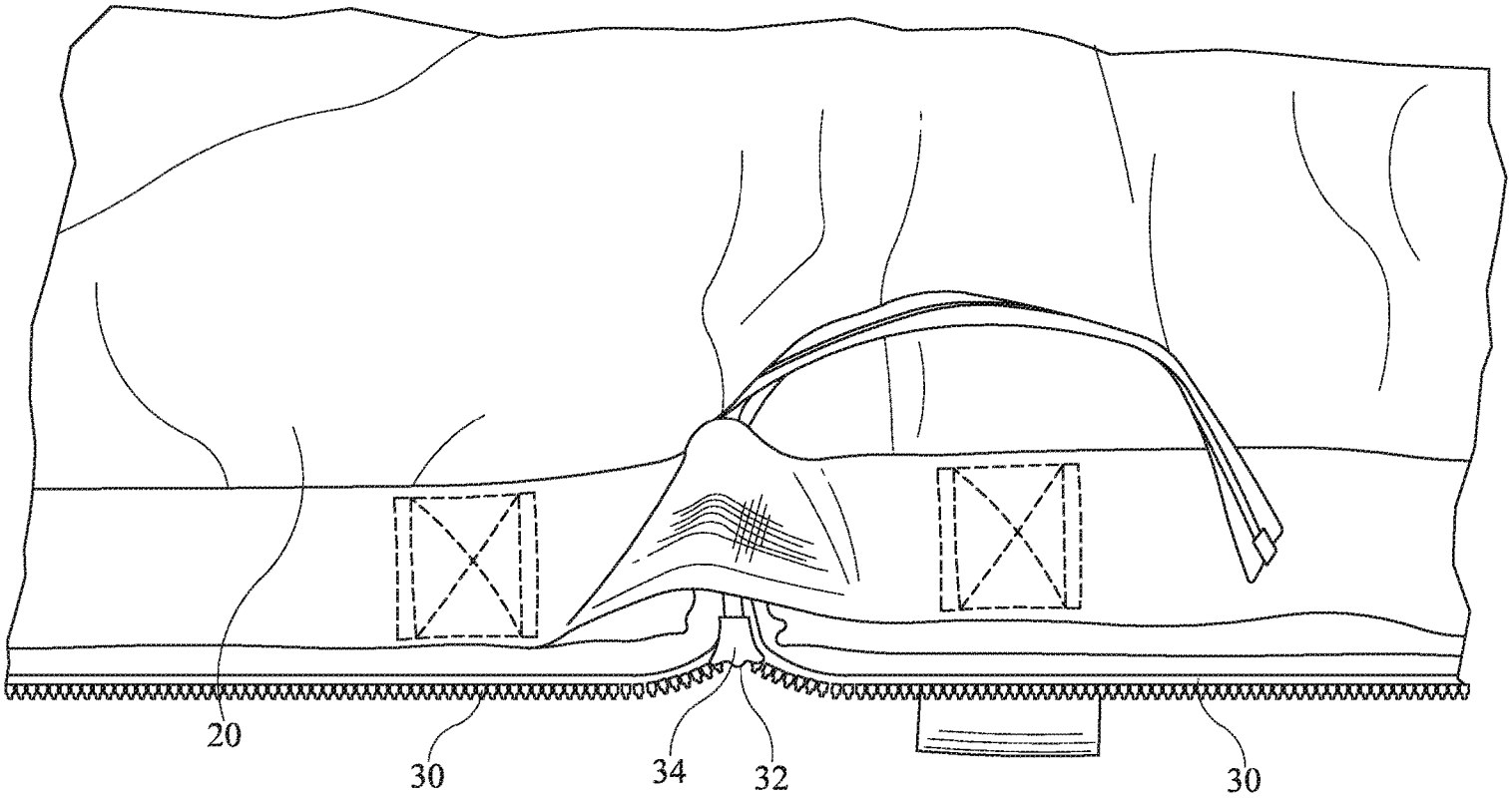
FIG. 12 is a detail view of a zipper assembly in accordance with one embodiment of the present invention.

As seen in the detail shown in FIG. 12, zipper 30 may, in one embodiment of the invention, comprise a coat-type zipper, whereby both zipper 30 chains are completely separable, depicted in FIGS. 8 and 9 at point 32. Zipper 30 slider 34 remains free to slide on one zipper 30 chain, but bag 10 can be completely opened up to form a litter without putting stress on zipper 30. As best seen in FIG. 7, when bag 10 is zipped closed, zipper 30 slider 34 may be secured in place utilizing a hook-and-loop type fastener flap 36 secured to bag 10 top seam 42. This feature of the invention prevent zipper 30 from inadvertently separating, thus further securing bag 10 contents.

Referring again to FIGS. 8 and 9 and in accordance with one embodiment of the invention, a plurality of hook-and-loop closures 38 (otherwise known by the trade name Velcro®) are secured to the perimeter of second long side 68 at a plurality of points. When bag 10 is partially folded as seen in FIG. 8, closures 38 engage each other along the perimeter to hold bag 10 in this partially folded position while zipper 30 is secured to complete the process of assembling bag 10 from its litter configuration.

Thus the description above sets forth a field transport system 10 suitable for securing, protecting and carrying gear while being readily convertible to a litter or stretcher with minimal time and effort.

The foregoing detailed description of the embodiments of the invention is presented primarily for clearness of understanding and no unnecessary limitations are to be understood or implied therefrom. Modifications to the present invention in its various embodiments will become obvious to those skilled in the art upon reading this disclosure and may be made without departing from scope of the invention and the claims appended hereto.

We claim:

1. A field transport system comprising:

a flexible material base layer, generally rectangular in shape, said base layer having first and second short sides and first and second long sides;

a zipper secured to said base layer around said first short side and around a portion of said first long side, said zipper traversing said base layer from said first long side to said second long side;

a frame comprising a flexible material secured around the perimeter of said base layer having a plurality of handles secured thereto, and a plurality of flexible material ribs secured to said base layer from said first long side to said first short side;

a handle secured to said frame at the intersection of said base layer first and second short side and said first and second long side, thereby providing a plurality of handles at the corners of said base layer, and a pole pocket secured to each of said plurality of handles located at said corners;

at least one combat pole engaging and being captured by said plurality of pole pockets for supporting said base layer; and whereby said base layer may be folded and zipped together to form a bag.

2. A field transport system as claimed in claim 1 comprising:

a drawstring secured along a portion of said second long side of said base layer for closing said bag.

3. A field transport system as claimed in claim 1 wherein said zipper comprises a separable zipper thereby permitting complete unfolding of said backbone.

4. A field transport system as claimed in claim 1 wherein said base layer comprises a ripstop nylon material.

5. A field transport system as claimed in claim 1 wherein said frame comprises ripstop nylon material.

6. A field transport system as claimed in claim 1 wherein said plurality of handles comprises flash spun high density polyethylene material.

7. A field transport system as claimed in claim 1 comprising:

a plurality of hook and loop closures secured to a portion of said second long side perimeter for securing said second long side to itself when said base layer is folded.

* * * * *